United States Patent [19]

Rosen

[11] 3,971,494

[45] July 27, 1976

[54] VALVE SYSTEM FOR FILLING MACHINES

[76] Inventor: Sidney Rosen, 4119-27 Fordleigh Road, Baltimore, Md. 21215

[22] Filed: Sept. 2, 1975

[21] Appl. No.: 609,541

[52] U.S. Cl. ..... 222/450

[51] Int. Cl.[2] ..... B67D 5/18

[58] Field of Search ..... 222/450, 571, 529, 214

[56] References Cited

UNITED STATES PATENTS 3,467,151 9/1969 Vogt ..... 222/450 X

*Primary Examiner*—Stanley H. Tollberg

*Attorney, Agent, or Firm*—Craig & Antonelli

[57] ABSTRACT

A valve system for use with a high-speed filling machine, in which a solenoid valve controlled by the main shaft of the filling machine, selectively supplies air under pressure to a respective pneumatically operated piston-cylinder unit which in its turn actuates a pinch clamp valve or a rotary valve to thereby effectively close the discharge or intake of the filling pump; with the use of a pinch clamp valve, its piston clamp assembly closes a hose section connected to the pump of the filling machine during its reciprocatory movement by pinching the same against a clamping bar of the pinch clamp frame structure; two rotary valves or pinch clamp assemblies may be used thereby, one for the intake cycle and one for the discharge cycle of the filling pump, which are then both controlled from the main shaft by the electromagnetically controlled solenoid valve.

27 Claims, 8 Drawing Figures

VALVE SYSTEM FOR FILLING MACHINES

The present invention relates to a valve system, and more particularly to a pinch clamp valve system for use in high-speed filling machines for high-speed filling of small containers, bottles, vials and ampoules.

Filling machines of this type are known in the prior art. For example, my prior U.S. Pat. No. 2,807,213 discloses a filling machine of this type in which weighted ball valves are used as inlet and discharge valves, closing off the connection with the discharge nozzle during the suction stroke of the filling pump and the connection with the container or reservoir containing the product to be filled during the discharge stroke of the filling pump. While this prior art construction has proved completely satisfactory for the normal products consisting of water-thin or viscous liquids, difficulties have been encountered in the use of this machine when filling a product with suspended solids or particles. For example, when filling a product such as orange juice with pulp and seeds, charcoal slurry solutions, pizza sauce containing seeds and other semi-solids, etc., the particles lodge under the ball seats and prevent proper operation.

The present invention is concerned with the task to overcome the problems encountered with the prior art constructions and to provide a valve system capable of handling products of the most varied type including products in which solids and semi-solids are present.

The underlying problems are solved according to the present invention by the use of a novel valve system, which utilizes air-operated pinch clamp valves or rotary valves operable in such a manner that during the suction stroke, the intake valve is opened and the outlet valve is closed while, during the discharge stroke, the intake valve is closed and the outlet valve is opened. The supply of air under pressure is thereby controlled by at least one electromagnetically controlled solenoid valve whose energization is controlled from the main shaft or the like of the filling machine, for example, by the use of a cam-operated microswitch. Seeds or other semi-solid particles that would otherwise lodge in the ball valves, have no effect whatsoever on the operation of the filling machine utilizing the new valve system in accordance with the present invention.

In one particularly advantageous construction of the present invention, the pinch clamp valve is actuated by a piston within a pneumatically operated air cylinder, whose piston rod is connected with the piston clamp assembly.

According to another feature of the present invention, the piston clamp assembly consists of a simple tubular stock, bevelled off at the hose engaging end, where it receives a cylindrical pinching member suitably secured to the tubular stock by suitable means, for example, by welding. This enables a rugged yet extremely simple and inexpensive piston clamp assembly of the pinch clamp valve which can be readily manufactured and adapted for various purposes. Additionally, the various structural elements forming the frame of the pinch clamp valve in accordance with the present invention are assembled from simple elements by the use of threaded connections which results in a sturdy pinch clamp valve assembly enabling simple assembly and assuring long length of life in operation.

According to a still further feature of the present invention, the pinch clamp valve assembly may also be used directly with the nozzle to prevent dripping after the filling operation. Furthermore, to minimize the danger of after-dripping after completion of the filling operation, a speed control device may be attached to the inlet of the pneumatic pinch clamp valve actuating cylinder so as to control the speed of the inflow of air into the cylinder and thereby slow down the closing of the pinch clamp valve during the beginning of the suction stroke of the pump whereby any product to be filled by the machine which is still present in the filling nozzle will be sucked back by the suction pump during the beginning of the suction stroke.

According to another embodiment of the present invention, rotary valves are used in lieu of the pinch clamp valves where the product is extremely viscous and must therefore be dispensed with under high pressure.

Pinch valves and rotary valves, broadly speaking, are known as such. However, their use in high-speed filling machines of the type described above not only solves a particular problem when filling products containing small solid particles or semi-solid particles suspended therein, but additionally increases the accuracy of the filling operation in a surprising manner. For example, filling accuracies 0f about ± 0.1% to about ± 0.5% depending on the product being filled were realizable with the novel valve system in accordance with the present invention. These results are surprisingly better than obtainable heretofore with the ball valves which only enabled accuracies that were considerably poorer by a factor of 2 to 10 times and even more.

Accordingly, it is an object of the present invention to provide a valve system for high-speed filling machines which avoids by simple means the aforementioned shortcomings and drawbacks encountered in the prior art.

Another object of the present invention resides in a valve system for high-speed filling machines which enables the filling of products of the most varied types, including filling of products containing solids or semi-solids suspended therein, without the danger of malfunctioning of the valves and dripping by the filling nozzles.

A further object of the present invention resides in a pinch vlave system for high-speed filling machines which is simple in construction, reliable in operation and rugged in construction.

Another object of the present invention resides in a pinch clamp valve assembly which is not only sturdy, utilizes simple structural parts that can be readily assembled and insures long life of operation of the system, but also positively precludes any afterdripping by the filling nozzles.

Still another object of the present invention resides in a valve system for filling machines which significantly increases the filling accuracy of the machine, yet requires no expensive metering systems prone to rapid wear and requiring costly maintenance and careful readjustment.

These and other objects, features and advantages of the present invention will become more apparent from the following description when taken in connection with the accompanying drawing which shows, for purposes of illustration only, several embodiments in accordance with the present invention, and wherein.

Figure 1:
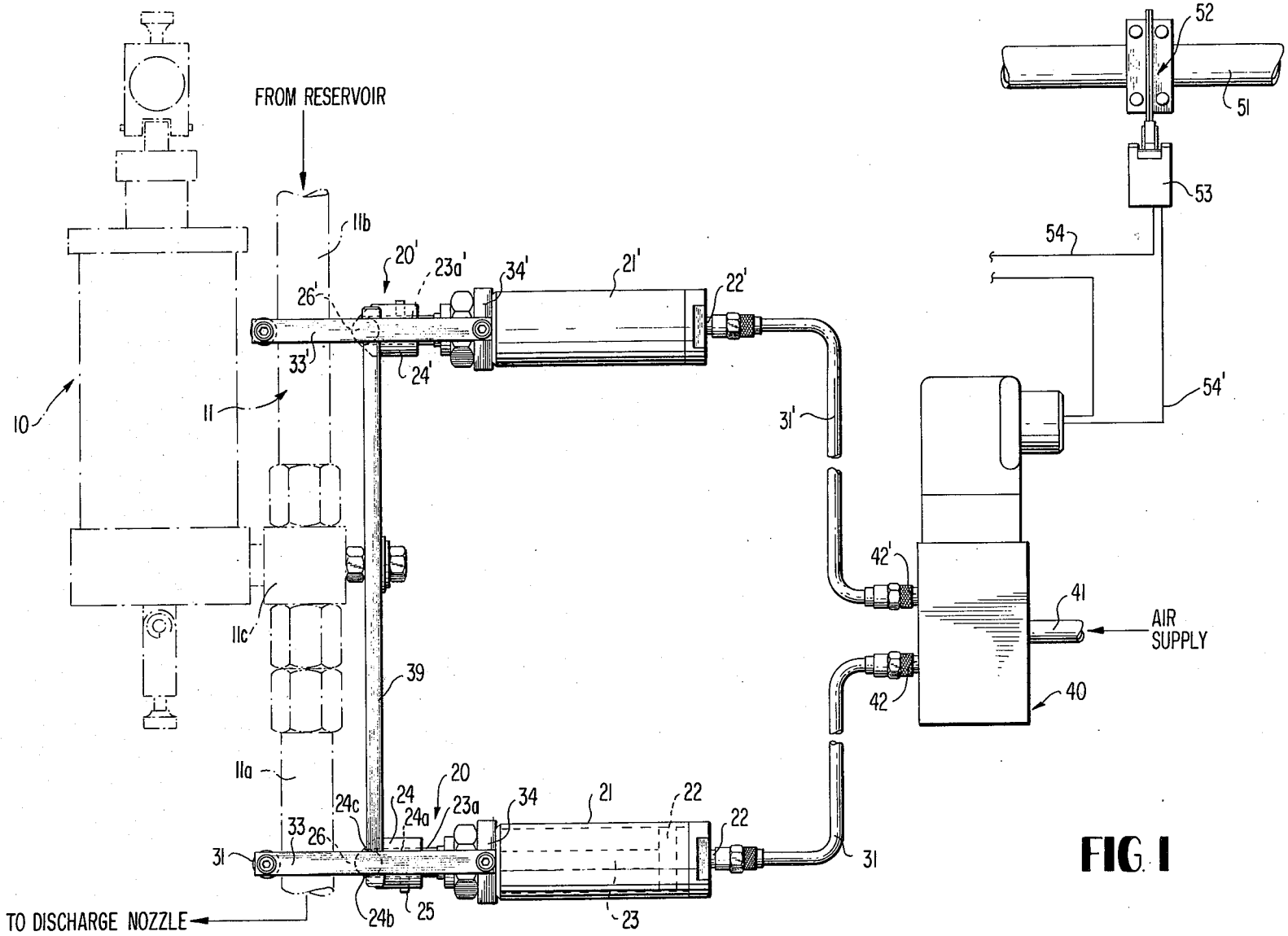
FIG. 1 is a somewhat schematic elevational view of a valve system in accordance with the present invention utilizing pinch clamp valves.
Figure 2:
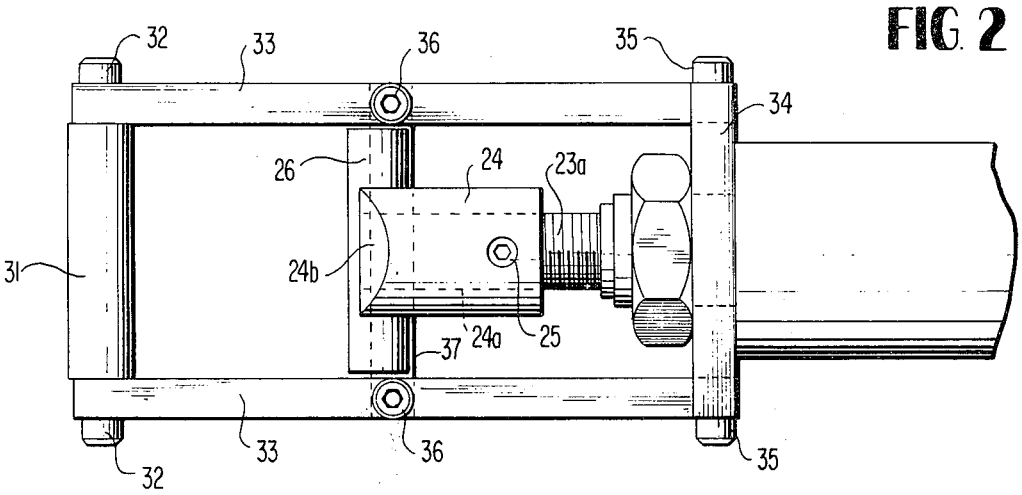
FIG. 2 is a somewhat schematic partial plan view on a pinch clamp valve assembly of FIG. 1.

Referring now to the drawing wherein like reference numerals are used throughout the various views to designate like parts, and more particularly to FIGS. 1 and 2, reference numeral 10 generally designates a filling unit of any conventional construction and therefore shown only schematically, whose pump space is in communication with the hose generally designated by reference numeral 11 by conventional means. The lower hose section 11*a* is thereby connected with its other end (not shown) to the discharge nozzle containing the product to be filled while the upper hose section 11*b* is connected at its other end with the reservoir or tank (not shown).

According to the present invention, two pinch clamp valve assemblies generally designated by reference numeral 20 and 20′ are provided as intake valve and discharge valve, respectively. Since the pinch clamp valve assemblies are similar instructures, only the lower pinch clamp valve assembly operating as intake valve will be described in detail, similar primed reference numerals being used for the upper pinch clamp valve assembly 20′ operating as discharge valve.

More particularly, the intake pinch clamp valve assembly 20 includes an air cylinder 21 with an air intake 22 for connection with an air line 31 supplying the pneumatic medium under pressure. A piston 22 having a piston rod 23 is slidably received within the cylinder 21 and extends with its piston rod 23 outside of the air cylinder 21. At the threaded forward end 23*a* the piston rod 23 carries the piston clamp, properly speaking. The latter consists of an axially extending piston clamp portion 24 of tubular stock having an internally threaded bore 24*a* which is screwed over the threaded end 23*a* of the piston rod 23. A set screw 25 is used to hold the piston clamp portion 24 in proper position on the piston rod extension 23*a*. The forward end of the piston clamp portion 24 is bevelled off at 24*b* and 24*c* to provide a wedge-like shape as viewed in side view of FIG. 1. The hose pinching member 26, properly speaking, is a piece of round stock of suitable dimensions which extends transversely of the piston clamp member 24 and is welded into a transversely extending bore or recess provided in the latter at the left end thereof as shown in FIGS. 1 and 2.

The frame structure for the pinch clamp assembly includes a transversely extending clamp bar 31 to which are secured by screws 32, two longitudinally extending brace members 33 which, in turn, are fastened to an annular cylinder bracket 34 by means of screws 35. Screws 36 thereby fasten onto the two longitudinal brace members 33 a centrally disposed transversely extending member 37 so as to further impart rigidity to the frame structure.

The two air feed lines 31 and 31′ are connected with a solenoid valve generally designated by reference numberal 40 which is of conventional construction and is operable to selectively valve the air under pressure fed at its inlet 41, to its two outlets 42 and 42′.

Mounted on the pump shaft or main shaft 51 of the filling machine is a cam assembly generally designated by reference numeral 52 which activates a microswitch 53 that closes the schematically indicated energizing circuit 54, 54′ energizing the solenoid valve 40, when the main shaft 51 rotates through a predetermined angular range.

OPERATION

The operation of the pinch clamp valve system in accordance with the present invention is as follows.

The cam 52 which is mounted on the main shaft of the filling machine closes the microswitch 53 as the cam rotates to an angular position corresponding to the beginning of the discharge stroke of the pump in the filling machine. Closing of the microswitch 53 causes the energizing circuit of the solenoid valve 40 so as to direct air under pressure to the bottom cylinder 21. This in turn will displace the piston 22 thereof toward the left as viewed in FIG. 1, so that the pinch clamp valve 24, 26 is displaced toward the left and closes off tightly the bottom hose section 11*a* by pressing the same against the clamp bar 31 while the product is being sucked in through the discharge hose section 11*b*. After the cam 52 has rotated through about 180°, the microswitch 53 is opened again, so that the air is now switched by the valve 40 from the bottom cylinder 21 to the top cylinder 21′. As a result thereof, the intake hose section 11*b* is now closed off tightly while the discharge section 11*a* is opened, for example, by the action of a return spring in cylinder 21 so that the pump in the filling unit 10 can now suck in a new supply of the product to be filled.

In order to futher increase the rigidity of the system, the upper and lower pinch clamp assemblies may be interconnected by means of a mounting bracket 39 which is suitably fastened to the T-shaped connector 11*c* fixedly mounted or connected to the filling unit 10. The line sections 11*a* and 11*b* are then suitably fastened to the ends of the T-shaped connector 11*c*.

Various types of pneumatically operated piston-cylinder units 21, 22 may be used. For example, depending on the size of the hose, etc., the piston 22 may be spring-loaded to hold the same in the open position, the pneumatic medium under pressure then displacing the piston against the spring force. In the alternative, double acting pneumatically operated cylinder-piston assemblies may be used, in which cast the solenoid valve 40 will selectively supply the air under pressure to opposite sides of the piston 22 and 22′ within the cylinder 21, 21′, as required for proper operation. Furthermore, various solenoid-operated valve structures, as are commercially available, may be used for the solenoid 40 in accordance with the present invention.

Figure 5:
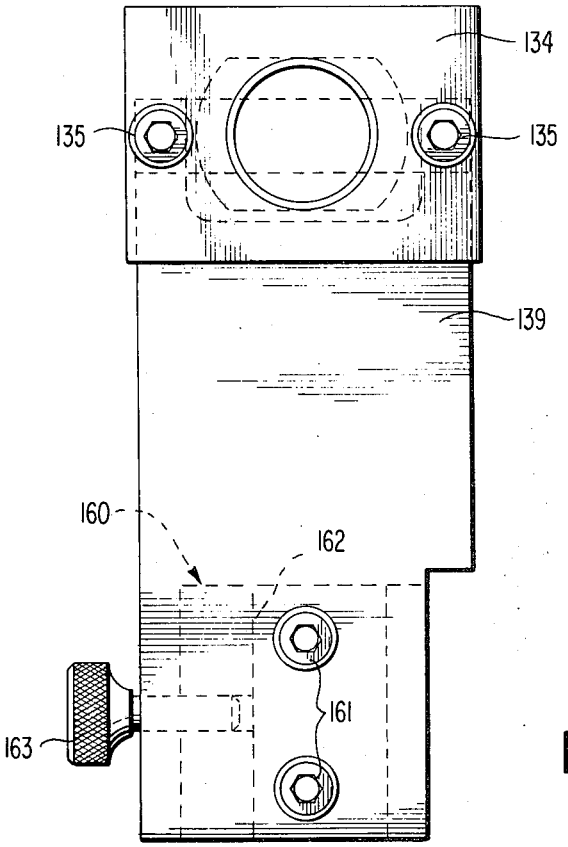
FIG. 5 is a somewhat schematic cross sectional view taken along line V—V of FIG. 3.
Figure 3:
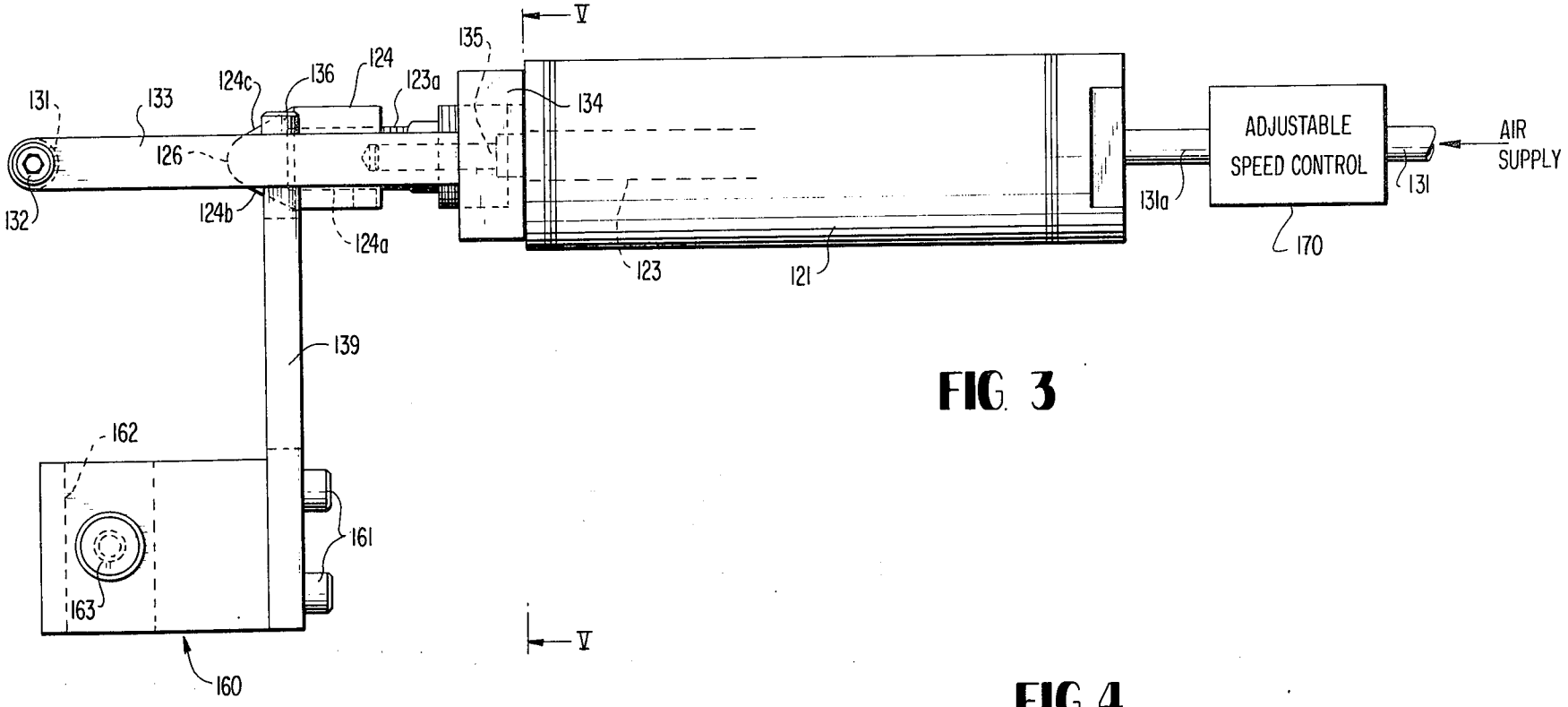
FIG. 3 is a somewhat schematic elevational view of a modified embodiment of a pinch clamp valve assembly in accordance with the present invention for pinching off the hose directly over the nozzle.
Figure 4:
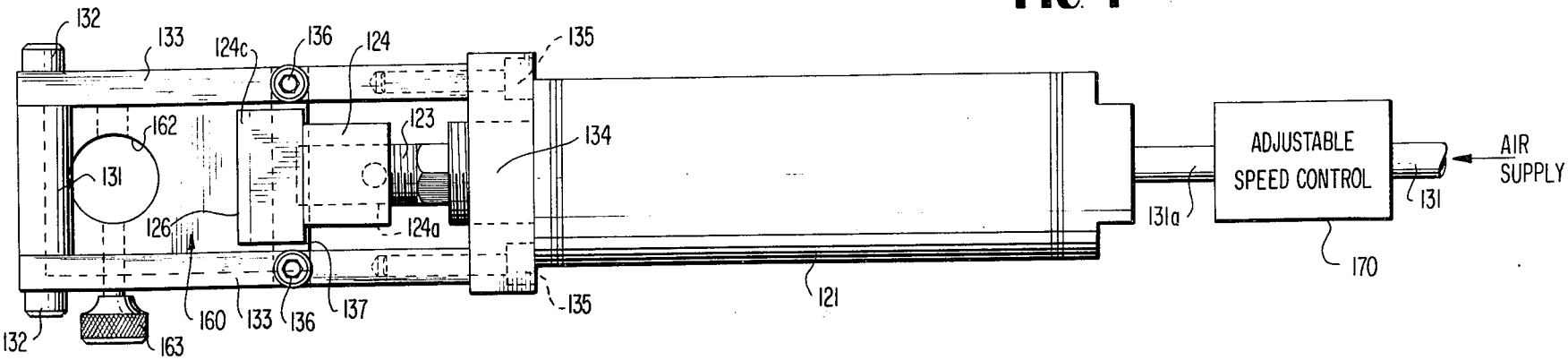
FIG. 4 is a somewhat schematic top plan view on the pinch clamp valve assembly of FIG. 3.

FIGS. 3–5 illustrate a modified embodiment of a pinch clamp valve assembly in accordance with the present invention which can be used for pinching off the hose directly over the filling nozzle so that the product can be kept from dripping out of the nozzle. Similar parts to those used in the embodiment of FIGS. 1 and 2 will be designated by corresponding reference numerals of the 100 series and will therefore not be described in detail. Differing from the embodiment of FIGS. 1 and 2, the embodiment of the nozzle-type pinch clamp valve assembly of FIGS. 3–5 includes a mounting bracket 139 which carries at its lower end a nozzle block member generally designated by reference numeral 160, to which the bracket 139 is threadably secured by means of screws 161. The nozzle block member 160 is provided with a vertically extending bore 162 through which extends the filling nozzle (not shown) of conventional construction or a part moving in unison therewith. A thumb screw 163 serves to fasten the nozzle block member 160 to the nozzle structure. The upper end of the mounting bracket member 139 is threadably secured to the longitudinally extending brace members 133 by means of screws 136, the screws 136 also serving to fasten the transversely extending bracing member 137 to the longitudinal bracing members 133. At its left end, as viewed in FIGS. 3 and 4, the frame structure is completed by a transversely extending clamp bar 131 threadably secured to the longitudinally extending brace members 133 by means of screws 132. The air cylinder bracket 134 which is somewhat wider and of more sturdy construction than in the embodiment of FIGS. 1 and 2, is secured to the longitudinally extending brace members 133 by means of longitudinally extending screws 135. The piston clamp assembly which again includes a cylindrical portion 124 and a transversely extending portion 126, is again threadably mounted over the externally threaded end 123*a* of the piston rod 123 by means of its internal threaded bore 124*a*. The transversely extending portion 126 is either formed integral with or secured to the tubular stock portion 124. In this embodiment, the transversely extending hose-clamping member 126 which contacts the hose during the pinching action is of nose-cone-like configuration as viewed in side view (FIG. 3) having converging surfaces 124*b* and 124*c*. Preferably, the pinch clamp assembly of FIGS. 3–5 is mounted directly on the bottom-up motion device of the filling machine, causing the down and up motion of the filling nozzles. As mentioned before, the embodiment of FIGS. 3—5 is used for pinching off the hose directly over the nozzle whereby the product can be kept from dripping out of the nozzle which could be highly undesirable as it may soil the filling container and/or parts of the filling machine, such as the conveyor belt, etc., not to mention the waste in product and resulting deterioration of the efficiency.

According to the present invention, the usefulness of the nozzle type pinch clamp assembly of FIGS. 3—5 to prevent after-dripping can be further improved by the use of a speed control. FIGS. 3 and 4 schematically illustrate such a speed control unit generally designated by reference numeral 170 which is then interconnected in such a manner that the inlet thereof is connected with the air supply line 131 and its outlet is connected either directly or by way of a line section 131*a* with the inlet of the pneumatic cylinder 121. The adjustable speed control is a conventional throttling device, by means of which the speed of flow of the air under pressure into the cylinder 121 can be selectively throttled. Since such throttling devices are known in the art and are commercially available, a detailed description thereof is dispensed with herein. However, it should be noted that the speed control unit 170 which is preferably of the adjustable type serves the purpose to control the speed of the pinching action, i.e., the closing-off of the pinch valve during the suction stroke of the pump, thereby causing a suck-back effect on the nozzle during the initial phase of the suction stroke of the pump. In other words, by throttling the air supply to the cylinder 121, the speed of the pinching action of the pinch clamp assembly is slowed down so that the corresponding hose section is not completely pinched off until after the suction stroke by the pump has already commenced. Hence, it is possible by the use of the resulting suck-back effect to stop products from dripping that would be very difficult to cut off otherwise. As to the rest, the operation of the nozzle-type pinch clamp assembly of FIGS. 3–5 is similar to that of FIGS. 1 and 2, the solenoid valve (not shown) then being connected at its output with the line 131 leading to the inlet of the speed control unit 170.

Figure 6:
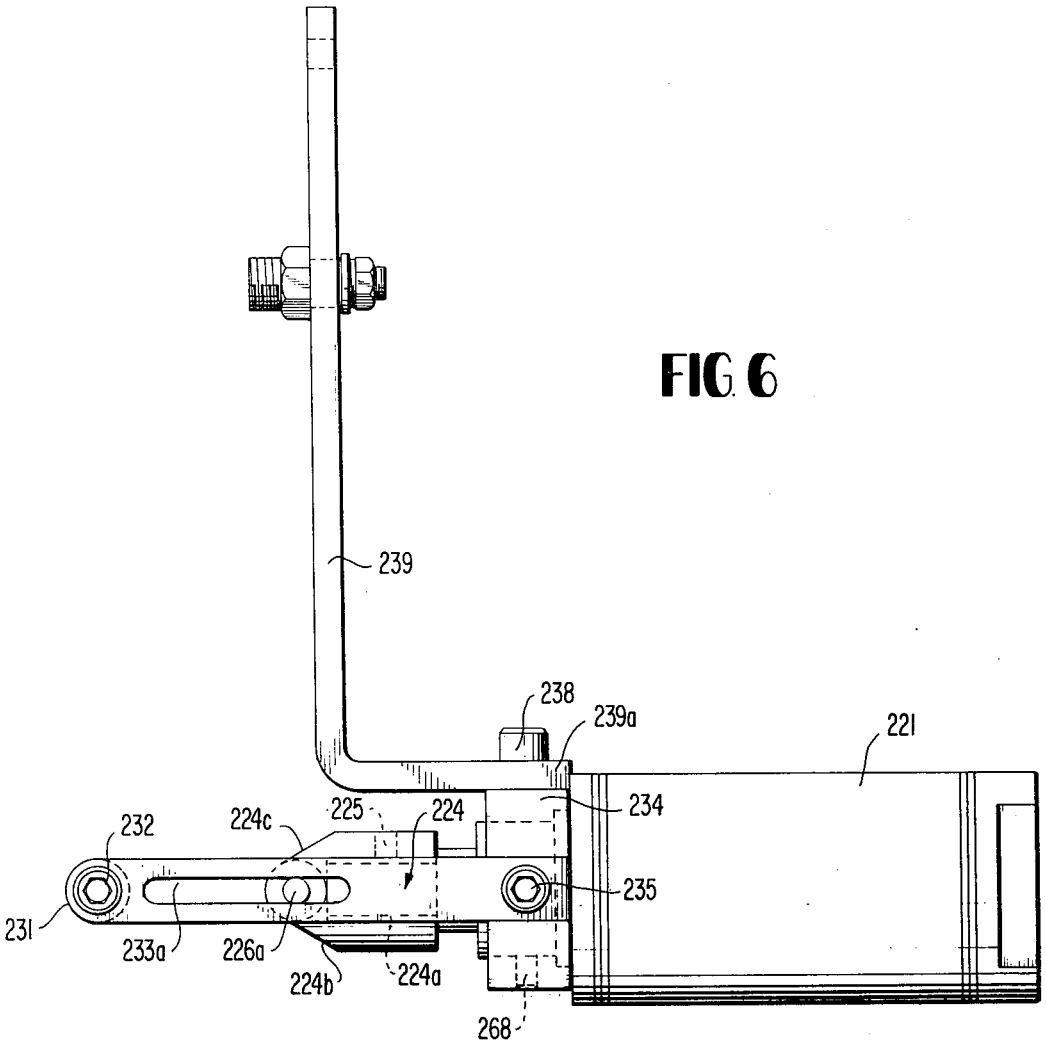
FIG. 6 is a somewhat schematic elevational view of a still further modified embodiment of a pinch clamp valve assembly in accordance with the present invention which may be used as intake valve when the pinch clamp valve assembly of FIGS. 3 to 5 is used.
Figure 7:
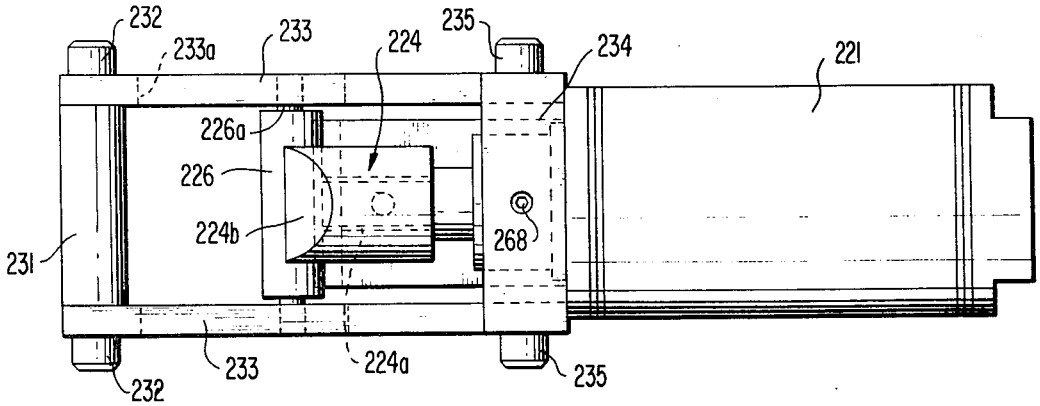
FIG. 7 is a somewhat schematic bottom plan view on the pinch clamp valve assembly of FIG. 6.
Figure 8:
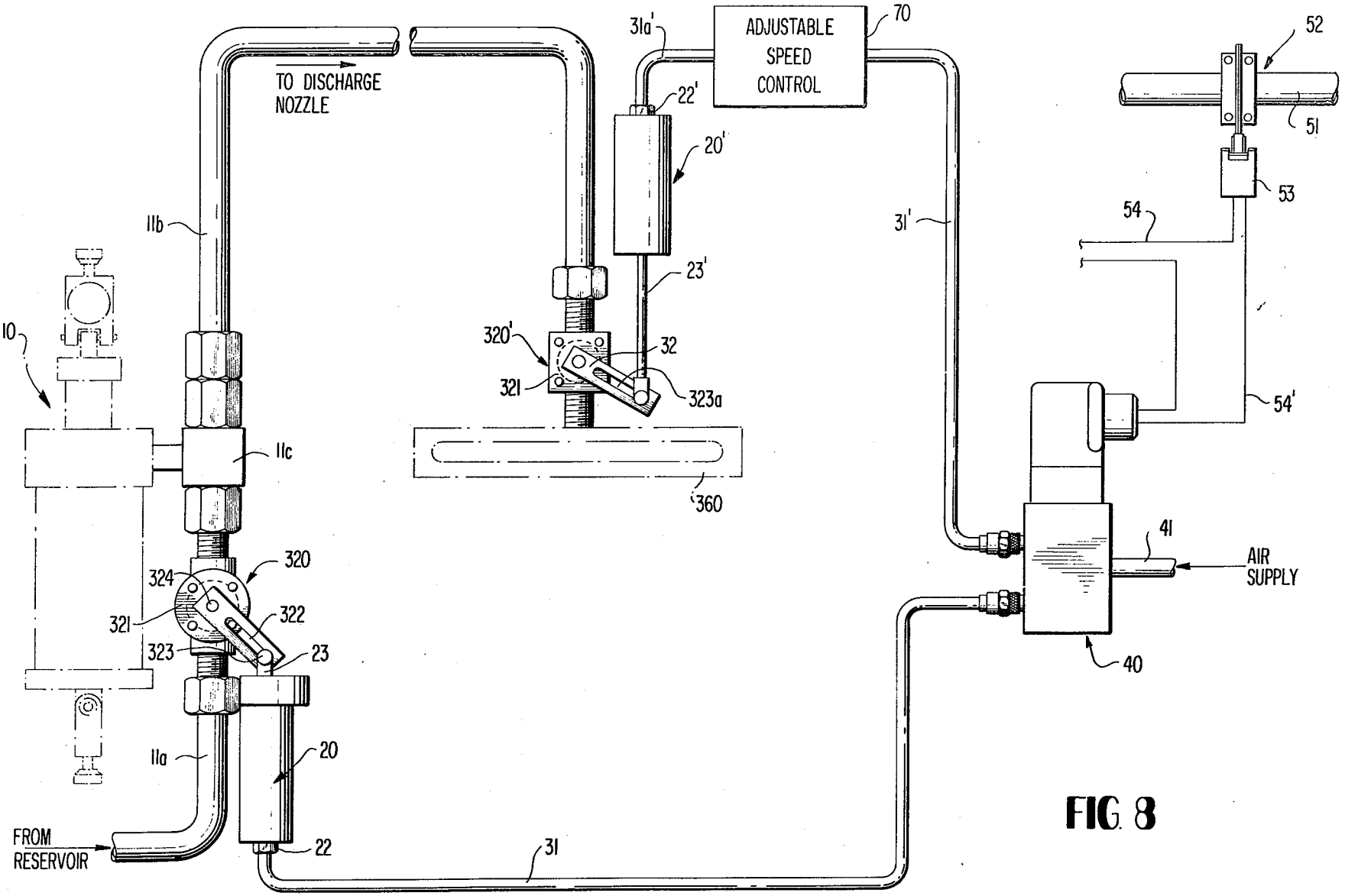
FIG. 8 is a schematic elevational view illustrating a valve system in accordance with the present invention utilizing rotary valves.

Normally, when a nozzle-type pinch clamp assembly as shown in FIGS. 3–5 is used, no pinch clamp valve structure as shown at the top of FIG. 1 and designated by the primed reference numerals is used at the pump. Instead, a pinch clamp assembly as shown in FIGS. 6 and 7 may then be used at the pump itself. Those parts similar to the embodiment of FIGS. 1 and 2 are designated by similar reference numerals of the 200 series. As can be seen from FIG. 6, the lower horizontally extending end 239*a* of the bracket 239 is secured to the air cylinder bracket member 234 by means of a screw 238, which together with a set screw 268 secures the bracket member 234 to the cylinder 221. The air cylinder bracket member 234 is again secured to the longitudinal brace members 233 by means of screws 235 while the longitudinal brace members 233 are again threadably secured to the clamp bar 231 by means of screws 232. Differing from the embodiment of FIGS. 1 and 2, the transversely extending hose pinching member 226 is provided with a short shaft or pin portion 226*a* which engages in the complementary elongated bore 233*a* of the right longitudinal brace member 233 as viewed in bottom plan view of FIG. 7 to provide an appropriate guidance.

The pinch clamp assembly of FIGS. 6 and 7 operates as the check valve for the intake and fits the bottom half of the pump of FIG. 1. It may be used with a nozzle pinch clamp assembly of FIGS. 3 to 5 which controls the discharge cycle.

As to the rest, the operation of FIGS. 6 and 7 as also that of FIGS. 3 to 5 is similar to the one described in FIGS. 1 and 2. However, in lieu of a cam control microswitch, mounted on the main shaft of the filling machine, also any other known control may be used.

Furthermore, the speed control of FIGS. 3 and 4 may also be used in an analogous manner with any of the other pinch clamp valve assemblies.

In case the product to be filled is extremely viscous, it must be dispensed under high pressure. Under these circumstances, a system as shown in FIG. 7 is preferable in which rotary valves are substituted for the pinch clamp valves of the embodiments in the preceding FIGURES. More specifically, in the embodiment of FIG. 7, the same parts as used in FIG. 1 are again designated by the same reference numerals while those differing therefrom are designated by reference numerals of the 300 series. As in the embodiment of FIG. 1, a filling unit generally designated by reference numeral 10 again includes a pump space which is in communication with a T-shaped connector 11*c*, rigidly connected with the filling unit. The hose section 11*a*, connected at its other end with a reservoir containing the product to be filled, is connected with the T-shaped connecting member by way of a rotary valve generally designated by reference numeral 320 which is of any conventional construction and therefore not described in detail. The rotary valve 320, in turn, is rigidly connected with the T-shaped connecting member 11*c* and includes a valve housing 321 accommodating a rotary valve member which is rotatably supported on a valve shaft 324 whose one end extends outside the valve housing 321 and is securely connected thereat with the crank-like actuating member 322 that is provided with an elongated slot 323 to slidably receive therein the pin type connection provided at the free end of the piston rod 23 of the pneumatically operated piston-cylinder unit generally designated by reference numeral 20. The latter is securely mounted on any fixed part, for example, at the housing of the filling unit so as to prevent relative movement between the valve housing 321 and the cylinder of the piston-cylinder unit 20. An electromagnetically operated solenoid valve generally designated by reference numeral 40 is again connected with one of its outputs to the inlet 22 of the piston-cylinder unit 20 by way of a line 31 while its other outlet is connected to the corresponding cylinder piston unit generally designated by reference numeral 20′ by way of the line 31′ and possibly by way of an interconnected adjustable speed control 70 which again is in the form of a conventional throttling device. The hose section 11*b* thereby leads to the discharge nozzle by way of the rotary valve generally designated by reference numeral 320′. Since the rotary valve and parts associated therewith which cooperate with the line section 11*b* are similar in construction and operation to that of the rotary valve 320 cooperating with the line section 11*a*, a detailed description thereof is dispensed with herein and corresponding primed reference numerals are used.

The solenoid valve 40 which is connected with its input 41 to the source of pneumatic medium under pressure is again controlled by means of a cam structure generally designated by reference numeral 52 which is mounted on the main shaft 51 or the like of the filling machine and closes a microswitch 53 in a predetermined angular position of the shaft 51 so as to close the schematically indicated energizing circuit 54, 54′ of the solenoid valve 40.

In operation, the various parts of the valve system of FIG. 7 operate in the same manner as those of FIG. 1, the adjustable speed control 70 performing the same function in the same manner as the adjustable speed control 170 of FIGS. 3 and 4.

The embodiment of FIG. 7 also illustrates the arrangement of the rotary valve 320′ and of its actuating unit 20′ in the manner analogous to that of the embodiment of FIGS. 3–5, i.e., near the discharge nozzle. For that reason, the rotary valve 320′ as well as the cylinder piston unit 20′ are rigidly connected with a part of the nozzle structure, such as with the support structure 360, indicated only schematically which provides for the up and down movement of the various nozzles of the filling machine.

As mentioned before, the operation of FIG. 7 is analogous to that of FIG. 1 and is believed apparent from the drawing, bearing in mind that the rotary valve, when displaced through a predetermined angle opens or closes a respective hose section as a result of the axial displacement of the piston rod 23 or 23′ which is operatively connected with a crank-like member 322 so as to translate the reciprocating movement of the piston rod into rotary movement of the shaft 324.

While, as pointed out above, the rotary valves may be necessary for certain applications, the pinch clamp valves offer an important advantage over the rotary valves in that they have no parts that need to be cleaned. In the pinch clamp valves simply a flexible tube is pinched off to shut off the liquid flow. Rotary valves, in contradistinction thereto, have to be disassembled for purposes of cleaning.

As to the rest, what was said in connection with the preceding embodiments is equally applicable to the embodiment of FIG. 7. It is, of course, readily understood that in lieu of a single solenoid valve 40, several such solenoid valves may be used so as to separately actuate each pinch clamp or rotary valve of a given line section. Furthermore, for increased flexibility, two cam-actuated microswitches may then be provided, one for each solenoid valve.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A valve system for a high-speed filling machine having a pump means which includes a shaft and a filling unit in operative connection with the shaft and in communication with hose means adapted to connect a reservoir containing the product to be filled with a discharge nozzle structure, said filling unit being operable to suck-in the product during the suction stroke of its pump means by way of a first hose section of said hose means and to discharge the product under pressure during the discharge stroke through the nozzle structure by way of a second hose section, characterized by a valve means operable as at least one of intake and discharge valve and operatively associated with the corresponding hose section to interrupt the flow of the product therethrough, a pneumatically operated piston-cylinder actuating unit for said valve means including a cylinder and a piston slidably received in said cylinder and having a piston rod operatively connected with the valve means for selectively opening and closing the valve means as a function of the reciprocating movements of the piston and piston rod, a solenoid valve means adapted to be connected with its input to a source of a pneumatic medium under pressure and operatively connected with at least one output thereof to the cylinder so as to displace the piston thereof by the selective feed of the pneumatic medium under pressure to the cylinder, an energizing circuit for said solenoid valve means including switch means, and means for closing said switch means in dependence on the angular position of said shaft.

2. A valve system according to claim 1, characterized in that the valve means is operable as discharge valve, and adjustable speed control means connected between the solenoid valve means and the cylinder to control the speed the closing of the valve means by the pneumatic medium under pressure.

3. A valve system according to claim 1, characterized in that two valve means and two actuating units are provided, one valve means being associated with one hose section and being actuated by one actuating unit and the other valve means being associated with the other hose section and being actuated by the other actuating unit, said solenoid valve means having two outputs, one each for a respective actuating unit.

4. A valve system according to claim 3, characterized in that the connection between the output of the solenoid valve means and the actuating unit actuating the discharge valve means associated with the second hose section includes adjustable speed control means to adjust the speed of closing of the discharge valve.

5. A valve system according to claim 1, characterized in that each valve means is a rotary valve.

6. A valve system according to claim 1, characterized in that each valve means is a pinch clamp valve assembly.

7. A valve system according to claim 6, characterized in that the pinch clamp valve assembly includes a piston clamp means secured on the piston rod extending out of the piston-cylinder unit, and frame means including a transversely extending clamping bar means secured to longitudinally extending brace means which in turn are secured to the piston-cylinder unit, the clamping bar means and piston clamp means being normally spaced from one another a distance at least equal to the diameter of the hose to be selectively closed off, and the hose being tightly closed off by pinching action when the piston clamp means is moved by the piston in the direction toward the clamping bar means.

8. A valve system according to claim 7, characterized in that the piston clamp means includes a first portion extending in the axial direction of the piston rod and a second transversely extending portion rigid with the end of the first portion nearer of the clamping bar means.

9. A valve system according to claim 8, characterized in that the first portion is of round stock with an internal threaded bore screwed over the externally threaded end of the piston rod.

10. A valve system according to claim 9, characterized in that the second portion is of bar stock secured to the recessed front end of the first portion.

11. A valve system according to claim 9, characterized in that the first portion is provided with bevelled end surfaces coverging in the direction toward the clamping bar means in such a manner that they are substantially tangential to the external configuration of the circularly shaped second portion.

12. A valve system according to claim 9, characterized in that the second portion is a transversely extending member having an approximately nose-cone-like configuration as viewed in side view.

13. A valve system according to claim 9, characterized in that the longitudinally extending brace means are secured to a cylinder mounting bracket means which is fastened onto the cylinder.

14. A valve system according to claim 13, characterized by further bracket means for securing the cylinder mounting bracket means onto a relatively fixed part of the filling unit.

15. A valve system according to calim 9, for clamping a hose section directly over a filling nozzle structure, characterized by bracket means for securing a nozzle block means to the frame means, the nozzle block means being provided with a bore for receiving a part of the filling nozzle structure, and means for fastening said part of the nozzle assembly.

16. A valve system according to claim 15, characterized by speed control means for controlling the speed of operation of the pinch clamp assembly, said speed control means being operatively connected between the source of pneumatic medium and the inlet of the piston cylinder unit.

17. A valve system according to claim 16, characterized in that the speed control means is an adjustable throttling device selectively controlling the rate of flow of the pneumatic medium under pressure to the cylinder unit.

18. A valve system according to claim 9, characterized in that said second portion is provided with a pin-like extension of reduced diameter guidingly received in an elongated complementary aperture of one of the longitudinal brace means.

19. A valve system according to claim 7, characterized in that said frame means consists only of two longitudinally extending brace members, of a cylinder mounting bracket means, and of at least one transversely extending member forming a clamping bar member against which the hose is clamped.

20. A valve system according to claim 7, wherein two pinch clamp assemblies are used, one for the intake cycle and one for the discharge cyle.

21. A valve system according to claim 20, characterized by control means controlling the operation of the two pinch clamp assemblies in dependence on the angular position of said shaft.

22. A valve system according to claim 20, characterized by means rotating at a speed proportional to the pump shaft and operable to close a switch means, said switch means being interconnected in an electric control circuit controlling the solenoid valve means which selectively supplies pneumatic medium under pressure to the intake pinch clamp assembly and the discharge pinch clamp assembly depending upon whether the corresponding pump unit of the filling machine is in its discharge cycle or intake cycle.

23. A valve systm according to claim 7, characterized in that the longitudinally extending brace means are secured to a cylinder mounting bracket means which is fastened onto the cylinder.

24. A valve system according to claim 23, characterized by further bracket means for securing the cylinder mounting bracket means onto a relatively fixed part of the filling unit.

25. A valve system according to claim 7, for clamping a hose section directly over a filling nozzle structure, characterized by bracket means for securing a nozzle block means to the frame means, the nozzle block means being provided with a bore for receiving a part of the filling nozzle structure, and means for fastening said part of the nozzle assembly.

26. A valve system according to claim 7, characterized by speed control means for controlling the speed of operation of the pinch clamp assembly, said speed control means being operatively connected between the source of pneumatic medium and the inlet of the piston cylinder unit.

27. A valve system according to claim 26, characterized in that the speed control means is an adjustable throttling device selectively controlling the rate of flow of the pneumatic medium under pressure to the piston-cylinder unit.

* * * * *